United States Patent [19]

Thompson et al.

[11] 4,110,990

[45] Sep. 5, 1978

[54] METHOD AND STRUCTURE FOR REHABILITATING SHEET PILE CELLULAR COFFER DAMS

[76] Inventors: Isadore Thompson; Rudolph Fehr, both of 133 Kearney St., San Francisco, Calif. 94108

[21] Appl. No.: 830,409

[22] Filed: Sep. 6, 1977

[51] Int. Cl.[2] ..... E02D 5/60

[52] U.S. Cl. ..... 405/14; 405/279

[58] Field of Search ..... 61/34, 50, 53.52, 54, 61/58, 59, 60, 86, 102; 52/259, 426, 583

[56] References Cited

U.S. PATENT DOCUMENTS

| | | | |
|---|---|---|---|
| 1,933,483 | 10/1933 | Pennoyer | 61/34 X |
| 1,951,293 | 3/1934 | Cahill | 61/34 |
| 2,001,473 | 5/1935 | Smith | 61/34 |

*Primary Examiner*—Paul R. Gilliam
*Assistant Examiner*—David H. Corbin
*Attorney, Agent, or Firm*—Julian Caplan

[57] ABSTRACT

To repair a pair of adjacent corroded sheet pile coffer dam cells a vertical metal plate is welded to the joint between the adjacent arches of sheet piling in alignment with the diaphragm between the cells which is also connected to the joint. A precast, post-tensional concrete arch of approximately the same length and depth as the sheet pile arch is spaced outwardly of each sheet pile arch. Exposed reinforcing bars of the concrete arch are secured to an extension of the metal plate. An outer vertical plate bridges the gap between the outer corners of adjacent concrete arches. The space inside the outer plate and the arch joint is filled with grout (e.g., Tremied concrete or pressure grout). The spaces between the new concrete arches and the pre-existing sheet pile arches are also filled. The lateral forces from the fill behind the concrete arches are resisted by tension of the existing diaphragm between cells. Use of "deadmen" and other anchoring devices is obviated.

14 Claims, 6 Drawing Figures

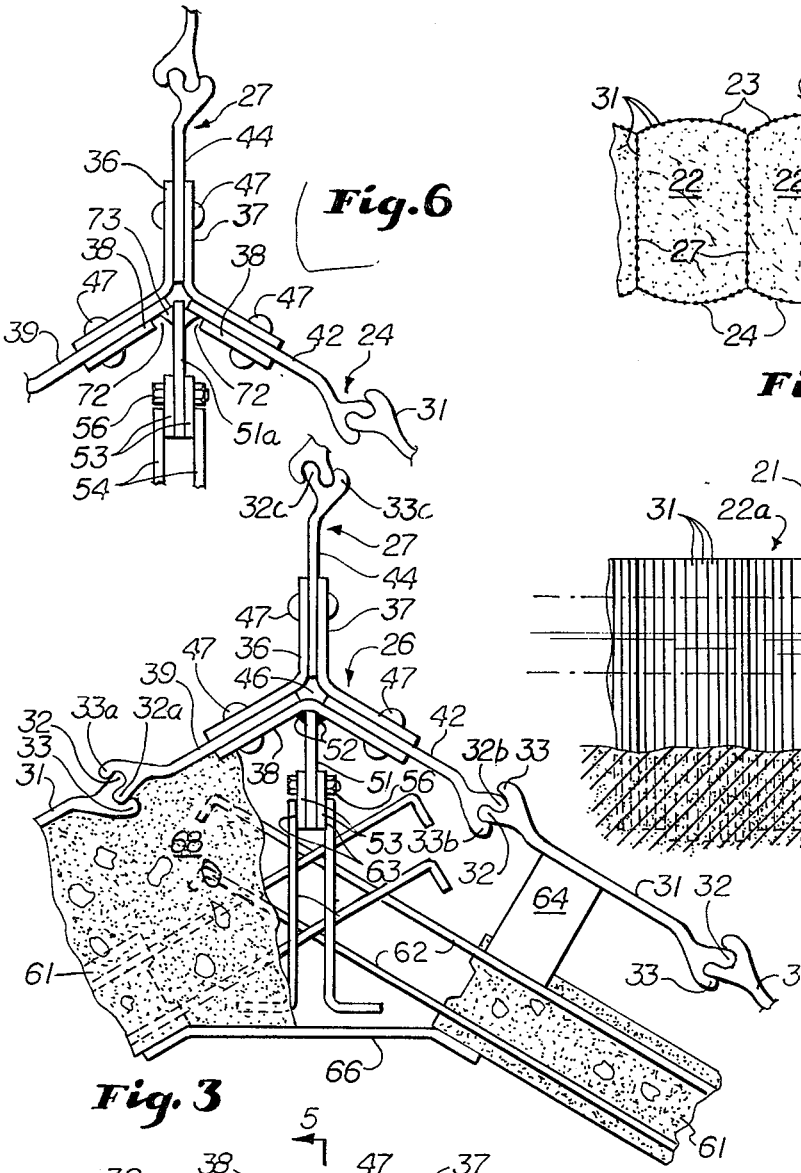
Fig. 6
Fig. 3
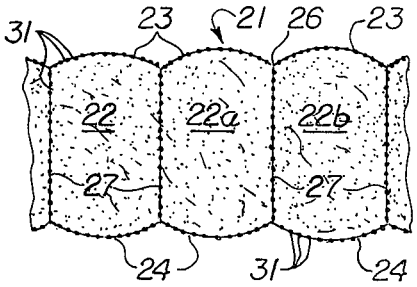
Fig. 1
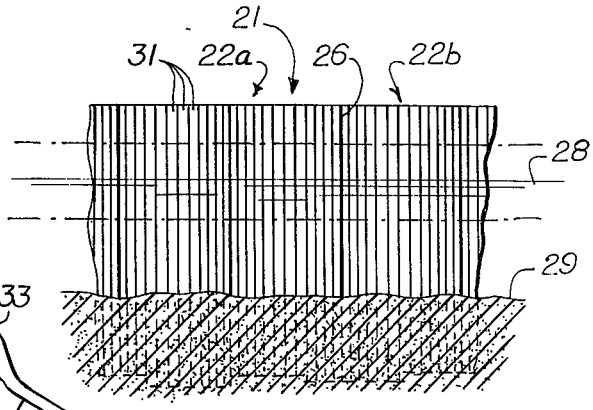
Fig. 2
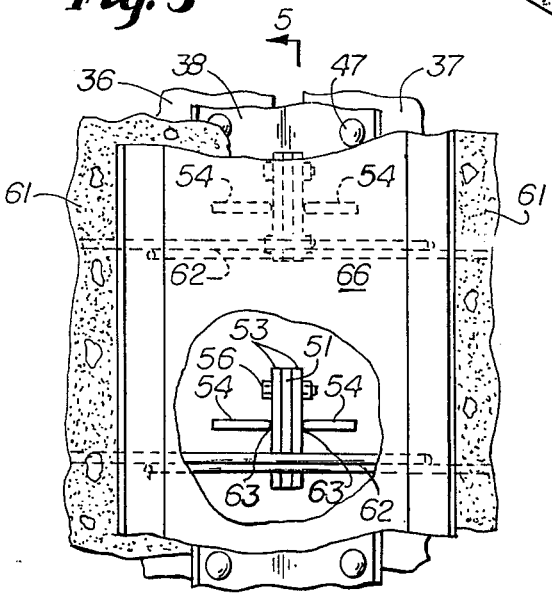
Fig. 4
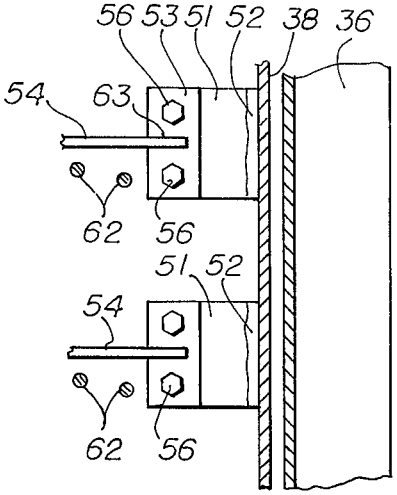
Fig. 5

METHOD AND STRUCTURE FOR REHABILITATING SHEET PILE CELLULAR COFFER DAMS

This invention relates to a new and improved method and structure for rehabilitating sheet pile cellular coffer dams. More particularly, the invention relates to rehabilitating coffer dams where corrosion of sheet piling has weakened the structure either by existing or future leakage of fill from within the unit of the coffer dam.

The present invention consists of a plurality of cells arranged side by side. Each cell conventionally has an outer arch made up of a series of sheet piles joined edge to edge, a similar inner arch, and an inter-connecting diaphragm which is common to adjacent cells. The inner arch and diaphragm are made up of sheet piling joined edge to edge in the same manner as the outer arch. Corrosion, particularly immediately below the water line, occurs; and if severe, the fill conventionally placed in each unit may leak out causing subsidence of the surface on top of the unit, and distortion and possible ultimate failure. The present invention is intended as one means of rehabilitating coffer dam units where corrosion has advanced to the point where the leakage is occurring or is imminent.

Heretofore, various means have been used to rehabilitate such structures. A very common type is to install horizontal bands of steel plate over the areas subject to the most intense corrosion, welding the bands to the piles. Such a method is inherently temporary and involves expensive welding operations.

A second means heretofore used is to drive sheet piles spaced outwardy of and parallel to the tangent of the outer arches to prevent displacement of the repair arch. Deadmen are placed or driven into the unit and connected to the new sheet piling by horizontal tie rods. Such a method is extremely expensive and necessitates interference with use of the area above and around the coffer dams during construction.

The present invention differs from prior methods and structures in that a new outer arch is installed immediately outward of the arch being rehabilitated and the new outer arch is tied to the diaphragms on either side of the arch. Thus the stress tending to deflect the new outer arch outwardly is transmitted in tension to the existing diaphragm. By using new arches on two adjacent cells, the tension forces parallel to the arch induced by lateral forces are balanced and the only unbalanced stress from the lateral forces is the stress in tension on the diaphragm. Such tension is absorbed partially by the inner arches or by friction of the fill of each cell against the face of the diaphragm. One principal advantage of the use of the present invention is that the rehabilitation accomplished thereby is more permanent than sheet pile and deadman method or patching methods heretofore used. Further, the result is much less expensive than the use of a new arch supported by a deadman and tie.

A still further advantage of the invention is the fact that the new structure may be installed much more rapidly than prior constructions.

A still further feature of the invention is the fact that less interference with the use of the structure supported by the coffer dam occurs while the repairs are being carried out.

Other objects fo the present invention will become apparent upon reading the following specification and referring to the accompanying drawings in which similar characters of reference represent corresponding parts in each of the several views.

In the drawings:

FIG. 1 is a schematic top plan view showing a plurality of adjacent coffer dam units of the type rehabilitated in accordance with the present invention.

FIG. 2 is a front elevational view of the structure of FIG. 2.

FIG. 3 is an enlarged fragmentary horizontal sectional view showing the present invention and partly broken away to reveal internal construction.

FIG. 4 is a front elevational view of a portion of the structure of FIG. 3, also broken away to reveal internal construction.

FIG. 5 is sectional view taken substantially along the line 5—5 of FIG. 4.

FIG. 6 is a fragmentary view similar to FIG. 3 of a modified construction.

Directing attention first to the structure of FIGS. 1 and 2, a coffer dam 21 of the type to be rehabilitated is schematically illustrated. The coffer dam 21 consists of a plurality of units or cells 22, the two cells 22*a*, 22*b* to be illustrated in describing the rehabilitation being shown. Each cell 22 has an outer arch 23 on one side and an inner arch 24 on the other, the arches preferably being complementary. The arches 23 of adjacent cells 22*a*, 22*b* are connected by a vertical (Y) joint 26. Between the adjacent unit is a common diaphragm 27 which is also connected to the joint 26 and is connected to a similar joint at the juncture of the inner arches. Each outer arch 23 is made up of a plurality of vertically disposed sheet piles 31 of steel, the piles extending from above the water line 28 to beneath the soil surface 29. Piles 31 are commercially available. At each edge they are formed with a joint making an extension commonly termed "fingers" 32 and "thumbs" 33, the finger 32 of each pile being received between the thumb and finger of the adjacent pile. The construction of the adjacent edges of the pile 31 permits the same to be driven and also permits the angular dispositions shown in FIG. 1. Similar piles 31 are used to make up the inner arch 24 and the diaphragm 27.

Where the walls 23 or 24 of adjacent units 22*a*, 22*b* meet, there is a joint 26 as best shown in FIG. 3. In a preferred embodiment, three obtuse angle members 36, 37 and 38 are employed. On the left side of joint 26, as viewed in FIG. 3, the edge of left pile connector 39 is sandwiched between adjacent flanges of left angle 36 and front angle 38. Similarly, right pile connector 42 is sandwiched between parallel flanges of right angle 37 and front angle 38. Diaphragm pile connector 44 is sandwiched between parallel flanges 36 and 37. A weld 46 at the common juncture of the angles 36, 37 and 38 may be employed and the sandwiching of the angles may be secured by rivets 47 or other fastening means, as illustrated. Each of the connectors 42 and 44 on its outer edge is attached to commercially available thumbs and fingers 32*a*, 33*a*, 32*b*, 33*b* and 32*c*, 33*c*, respectively, which mate with the adjacent thumbs and fingers of the next piles.

The foregoing structure is very commonly used for coffer dams in such locations as piers, and is intended to be permanent. Fill such as sand is compacted into the various units and supports surface structures. With the passage of time, however, corrosion of the piles 31 results, particularly adjacent the water line 28, and holes may be formed in the piles resulting in leakage of the fill within the various units, and subsidence of the surface on top of the unit. The present invention provides a method and structure for rehabilitating the corroded units. In the following description, repair of the outer arches 23 is described. Repair of the inner arches 24 is not required because they are driven into the ground and last indefinitely.

At vertically spaced intervals along the joint 26 between the units 22a and 22b which are here selected for description of repair, vertical plates 51 are welded. In the form of the invention shown in FIG. 3 where corrosion of the angle 38 has not advanced materially, welds 52 attach the plate sections 51 directly to the angle where the flanges of angle 38 meet and the plate sections 51 are in direct alignment (i.e., parallel to) the diaphragm 27, it being a characteristic of the present invention that the stress of the new arch hereinafter described is imposed upon the diaphragm 27 and is resisted by the arch 24 on the opposite face of ach unit 22a, 22b and also by the friction of the fill within the units 22a, 22b bearing against the diaphragm 27.

On the outer edge of plate 51 are strips 53 to which are connected by welds 63 outwardly extending L shaped reinforcing bars 54. The strips 53 are secured to the plate 51 by bolts 56 or other fastening means (including rivets or welding).

A pre-cast, pre-stressed concrete arch 61 parallel to outer arch 23 and of the same length and of a vertical depth to extend from the top edge of arch 23 to approximately the soil line 29 is provided. Vertical depth of arch 24 can be varied if for reasons of economy only partial protection of surface 23 is desired. Reinforcing bars 62 extend out from the edge of concrete arch 61. To assist in locating the arches 61, spacers 64 may be installed between the adjacent faces of the arch 23 and the arch 61. To protect the exposed bars 54, 62, a vertically extending plate 66 bridges the outer edges of the adjacent arches 61. A closure pour consisting of grouting 68 such as Tremied concrete or pressure grouting is used to fill the space between the arches 23 and 61 and the space within the plate 66 to complete closure of the arches to each other and transfer arch stresses to each other — and to the diaphragm.

The forces imposed on the arches 61 by the load within and on th top of each unit 22a, 22b, tends to bow the arch 61 outward — i.e., away from the arch 23. The lateral components of adjacent arches 61 counter balance each other through transfer of forces in the closure pour. The outward component of each arch 61 is transmitted through the closure by means of plate 51 directly to the diaphragm 27 and thus is resisted by opposite arches 24 and by the effect of the fill within the units 22a, 22b against the wall of the diaphragm 27, thereby preventing outward movement of the arches 61 and consequently loss of fill material in the coffer dam.

Directing attention now to the structure of FIG. 6, in some instances, corrosion of the angle 38 has considerably advanced so that it is not acceptable to weld the plate sections 51 thereto. Preliminary to installation of the device, vertical cuts 72 are made in the angle 38, exposing the connectors 39, 42. Thereupon the plate sections 51a are welded by means of welds 73 to the connectors 39, 42. In this modification, again, the forces tending to move the arches 61 (not shown in FIG. 6, but resembling those of FIG. 3) outward are imposed upon the diaphragm 27.

What is claimed is:

1. A coffer dam repair structure comprising a first arch having a plurality of vertically disposed sheet piles formed edge to edge and extending into the soil, each said pile having cooperating means on each vertical edge to connect said vertical edge to the vertical edge of an adjacent pile, a second arch adjacent said first arch having a plurality of piles formed and connected similar to the piles of said first arch, a diaphragm extending generally transverse to said first and second arches from the line of intersection of said arches, said diaphragm having a plurality of piles formed and connected similar to the piles of said first arch, a Y-shaped vertical joint joining together adjacent vertical edges of said first arch, second arch and diaphragm, a vertical plate secured to said vertical joint in alignment with said diaphragm and extending directly away from said diaphragm, a first repair arch generally similar in area to the area of said first arch placed above the soil and spaced outwardly of said first arch, a second repair arch similar to said first repair arch spaced outwardly of said second arch, and attachment means connecting the continuous edges of said repair arches to each other and to said vertical plate, whereby the components of force on said repair arches are balanced laterally perpendicular to said diaphragm and are resisted in an outward direction parallel to said diaphragm by said diaphragm.

2. A structure according to claim 1 in which each of said repair arches is a pre-cast, post-tensioned, reinforced concrete member.

3. A structure according to claim 2 which further comprises a vertical outer plate bridging the gap between the contiguous outer edges of said repair arches, and a closure pour of grouting between said outer plate and said vertical joint, said grouting covering said attachment means.

4. A structure according to claim 2 in which each of said repair arches has exposed, horizontal reinforcing bars extending out from said contiguous edges which, by anchorage in closure pour, transfers said reinforcing bar stresses to said vertical plate.

5. A structure according to claim 4 in which said reinforcing bar attachment means comprises strips, fastening means attaching said strips to said vertical plate, second and third reinforcing bars extending outward in line with said plate, said closure pour transferring repair arch stresses to each other and the second and third reinforcing bars and thereby into the diaphragm.

6. A structure according to claim 1 in which said Y-shaped vertical joint comprises three substantially identical angle bars disposed about 120° to the other, first, second and diaphragm pile connectors each having a first edge secured between overlapping flanges of a pair of said angle bars and a second edge having cooperating means for connection to the cooperating means on the edge of the adjacent pile of said first arch, second arch and diaphragm, respectively.

7. A structure according to claim 6 in which said vertical plate is welded to the intersection of the flanges of the outward facing angle bar.

8. A structure according to claim 6 in which the outward facing angle bar has been cut away at the intersection of its flanges to expose the underlying first, second and diaphragm connectors and in which said vertical plate is welded to at least two of said diaphragm connectors.

9. A method of repairing a coffer dam of the type having a first original arch having a plurality of vertically disposed sheet piles joined edge to edge and extending into the soil, each said pile having cooperating means on each vertical edge to connect said vertical edge to the vertical edge of an adjacent pile, a second original arch adjacent said first arch having a plurality of piles formed and connected similar to the piles of said first original arch, a diaphragm extending generally transverse to said first and second original arches from the line of intersection of said original arches, said diaphragm having a plurality of piles formed and connected similar to the piles of said first original arch, and a Y-shaped vertical joint joining together adjacent vertical edges of said first original arch, second original arch and diaphragm vertical joint in alignment with said diaphragm and extending directly away from said diaphragm, said method comprising attaching a vertical metal plate to said vertical joint in alignment with and extending outward from said diaphragm, setting a first repair arch spaced outward from said first original arch, said first repair arch being similar in area to the area of said first original arch above the soil, or of a lesser height than said original arch, setting a second repair arch spaced outward from said second original arch, said second repair arch being similar in area to the area of said second original arch above the soil, connecting the contiguous ends of said first and second repair arches to each other and to said metal plate through a closure pour, whereby the components of the stress on said repair arches perpendicular to said diaphragm are balanced and the component parallel to said diaphragm is transmitted to said diaphragm.

10. The method of claim 9 which further comprises the step of applying a second vertical plate across the contiguous outer edges of said repair arches and filling with grout the space between said second plate and said vertical joint to effect said closure pour.

11. The method of claim 9 in which said repair arches are pre-cast, post-tensioned reinforced concrete members.

12. The method of claim 11 in which said concrete members have reinforcing bars extending out of their contiguous edges and said step of connecting said ends of said repair arches to each other and to the diaphragm comprises a closure pour which transfers stress into adjacent arches and into said diaphragm through reinforcing bars welded to said plates and reinforcing bars extending from the repair arches.

13. The method of claim 9 which comprises initially cutting away corroded portions of said Y-shaped vertical joint and said step of attaching said vertical metal plate comprises welding said vertial metal plate to an extension of said diaphragm.

14. The method of claim 9 in which the original Y-shaped member of said coffer dam has an outward-facing obtuse angle metal member and said step of attaching said vertical metal plate comprises welding said vertical metal plate to said obtuse angle metal member.

* * * * *